US012276166B2

(12) United States Patent
Li et al.

(10) Patent No.: US 12,276,166 B2
(45) Date of Patent: Apr. 15, 2025

(54) DEVICE FOR PREVENTING ABRUPT BLOCKAGE IN BLOOIE LINE OF GAS DRILLING

(71) Applicant: Southwest Petroleum University, Chengdu (CN)

(72) Inventors: Hongtao Li, Chengdu (CN); Yingfeng Meng, Chengdu (CN); Gao Li, Chengdu (CN); Yijian Chen, Chengdu (CN)

(73) Assignee: SOUTHWEST PETROLEUM UNIVERSITY, Chendu (CN)

( * ) Notice: Subject to any disclaimer, the term of this patent is extended or adjusted under 35 U.S.C. 154(b) by 0 days.

(21) Appl. No.: 18/446,810

(22) Filed: Aug. 9, 2023

(65) Prior Publication Data

US 2024/0052713 A1 Feb. 15, 2024

(30) Foreign Application Priority Data

Aug. 10, 2022 (CN) ..... 202210956942.1

(51) Int. Cl.

| | |
|---|---|
| ***E21B 21/16*** | (2006.01) |
| ***E21B 21/01*** | (2006.01) |
| ***E21B 21/06*** | (2006.01) |
| ***E21B 21/07*** | (2006.01) |

(52) U.S. Cl.

CPC ..... *E21B 21/16* (2013.01); *E21B 21/011* (2020.05); *E21B 21/065* (2013.01); *E21B 21/07* (2013.01)

(58) Field of Classification Search

CPC ..... E21B 21/01; E21B 21/011; E21B 21/065; E21B 21/07; E21B 21/16

See application file for complete search history.

(56) References Cited

U.S. PATENT DOCUMENTS 4,161,222 A * 7/1979 Pye ..... E21B 21/16 175/71
6,162,284 A * 12/2000 Mitchell ..... B01D 21/283 96/195
8,708,065 B2 * 4/2014 Largent ..... B09C 1/02 175/208

(Continued)

OTHER PUBLICATIONS

IADC Lexicon. (n.d.). Blooie Line. In Oil & Gas Drilling Glossary. Retrieved Sep. 30, 2024, from https://iadclexicon.org/blooie-line/ (Year: 2024).*

(Continued)

*Primary Examiner* — Robert E Fuller

(74) *Attorney, Agent, or Firm* — MUNCY, GEISSLER, OLDS & LOWE, P.C.

(57) ABSTRACT

A device for preventing abrupt blockage in a blooie line of gas drilling includes a sand-storing tank body, which is connected to a rotating blowout preventer through a guiding tube, and a guiding three-way joint is set between the guiding tube and the sand-storing tank body and connected to the blooie line by a vertical guiding tube; the sand-storing tank body is connected to the blooie line by means of a gas discharge tube; a flap plate assembly is arranged at the position fronting straight onto the guiding three-way joint inside the sand-storing tank body, and configured to control the rock particles in the guiding tube to enter the sand-storing tank body, preventing blockage in the blooie line.

10 Claims, 17 Drawing Sheets

(56) References Cited

U.S. PATENT DOCUMENTS

| | | | | |
|---|---|---|---|---|
| 2008/0190668 | A1* | 8/2008 | Swartout | F23G 7/085 175/207 |
| 2013/0042761 | A1* | 2/2013 | Ring, Sr. | B04C 5/04 95/271 |
| 2013/0139694 | A1* | 6/2013 | Hughes | C02F 1/20 96/174 |

OTHER PUBLICATIONS

PetroWiki. (n.d.). Blooie Line. In SPE Glossary. Retrieved Sep. 30, 2024, from https://petrowiki.spe.org/Glossary:Blooie_line (Year: 2024).*

* cited by examiner

DEVICE FOR PREVENTING ABRUPT BLOCKAGE IN BLOOIE LINE OF GAS DRILLING

FIELD OF THE INVENTION

The present invention relates to the technical field of oil-and-gas exploration technology, in particular to a device for preventing abrupt blockage in blooie line of gas drilling.

BACKGROUND OF THE INVENTION

In the process of normal gas drilling, a drill bit rotates with the circulation of injected air and continuously crushes rock at the bottom hole under the action of the bit weight, so as to continuously and stably produce a small amounts of rock cuttings and dust, which are promptly and stably brought out of the wellbore with gas flow. A small amount of rock cuttings and dust carried with the gas flow enter a blooie line, then are expelled to a flare pit via the blooie line, in this way, the blooie line cannot be blocked.

In the process of abnormal gas drilling, a large amount of solid particles and dust and a mass of muddy agglomerates or oil sands clumps may erupt from the wellbore. The causes of such large amount of solid particles abruptly generating from the wellbore may include: sudden instability of the local well wall, sudden initiation of sand settling at the bottom of the well, sudden collapse of an annular sand bridge, suddenly drilling into loose formations, drilling into a casing pocket with cement stone fragments, a gaseous rock burst (gas kick) in tight sandstone gas reservoirs (low porosity) with sparse fractures and so on, in particular, the gaseous rock burst in tight sandstone gas reservoirs with sparse fractures are the most common and dangerous. Such a large amount of solid particles abruptly generating, which suddenly, high densely enter the blooie line, very probably cause blockages at a bend, a dead-end, a necking, and a protrusion inside the blooie line. After the blooie line has been blocked, resultantly, the pressure at the wellhead and inside the blooie line promptly rise, thereby resulting in breaking the blooie line or bursting the rubber packer of the rotating blowout preventer at the wellhead, causing a serious accident, even a disaster.

SUMMARY OF THE INVENTION

The present invention aims to provide a device for preventing abrupt blockage in blooie line of gas drilling, so as to solve the technical problem that the blooie line is easily blocked in the process of gas drilling.

In order to achieve the above object, the technical scheme adopted in the present invention is as follows: a device for preventing abrupt blockage in blooie line of gas drilling, comprising: a sand-storing tank body, which is connected to a rotating blowout preventer through a guiding tube; a guiding three-way joint, which is set between the guiding tube and the sand-storing tank body and connected to a blooie line by a vertical guiding tube, wherein the sand-storing tank body is connected to the blooie line by means of a gas discharge tube; and a flap plate assembly, which is arranged at the position fronting straight onto the guiding three-way joint inside the sand-storing tank body, and configured to control the rock particles in the guiding tube to enter the sand-storing tank body, preventing blockage in the blooie line.

Further, the flap plate assembly includes a supporting seat and a flap plate, the flap plate is set on the supporting seat by means of a hinge shaft, a tongue skirt is arranged on the flap plate, a clump weight is arranged on the tongue skirt; a spheric balancer connecting rod is arranged on the hinge shaft, a spheric balancer is arranged on the spheric balancer connecting rod.

Further, an angle-measuring unit is further arranged inside the sand-storing tank body, the angle-measuring unit includes an angle sensor, a flipping-angle connecting rod and a flipping-angle connecting-rod-supporting tube, the angle sensor is arranged on the flap plate of the flap plate assembly, and connected to a wireless angle transmitter through an angle-measuring data wire, the wireless angle transmitter sends the angle angular data of the flap plate to a host for display, the angle-measuring data wire is arranged inside the flipping-angle connecting rod, one end of which is connected to the flap plate, and the other end of which is connected to the flipping-angle connecting-rod-supporting tube.

Further, a flipping-angle synchronizing rod is arranged on the flipping-angle connecting rod, the flipping-angle synchronizing rod synchronizes with the turn of the flap plate, when the turn-angle of the flap plate reaches a preset limit angle, the flipping-angle synchronizing rod hits on a limiter and cannot rotate further, the limiter is arranged on the displaying panel of the sand-storing tank body.

Further, a flap plate locking mechanism is further arranged on the displaying panel, the device is configured to pull the flipping-angle synchronizing rod to the concave position of the flap plate locking mechanism, then insert a deadlock bolt to lock the flipping-angle synchronizing rod.

Further, an accumulated-fragment's weight-measuring unit is further arranged inside the sand-storing tank body, the accumulated-fragment's weight-measuring unit includes an inner cup, a weight sensor and the base of weight sensor, the inner cup is arranged at the bottom of the sand-storing tank body; the base of weight sensor is arranged inside sand out of the sand-storing tank body, and supported by the latter; the weight sensor is arranged between the inner cup and the base of weight sensor; the weight sensor is connected to an wireless weight transmitter through an weight-measuring data wire, the wireless weight transmitter sends the signal of the weight of the fragments accumulated inside the sand-storing tank body to a host for display.

Further, a sand-inlet short tube is arranged between the guiding three-way joint and the sand-storing tank body, and connected to a sand-inlet opened on the sand-storing tank body, an anti-erosion fairing ring is set inside the sand-inlet.

Further, an exhaust port is arranged at the top of the sand-storing tank body, and connected to the gas discharge tube.

Further, a mass flowmeter and two single-disc check valves are arranged on the gas discharge tube.

Further, a T-shaped three-way joint is set on the blooie line, the T-shaped three-way joint is configured to connect the vertical guiding tube with the gas discharge tube.

The beneficial effect of the present invention is that: the present invention can effectively solve the technical problem that the process of gas drilling for oil-and-gas exploration and development is prone to abruptly block the blooie line.

Figure 1:
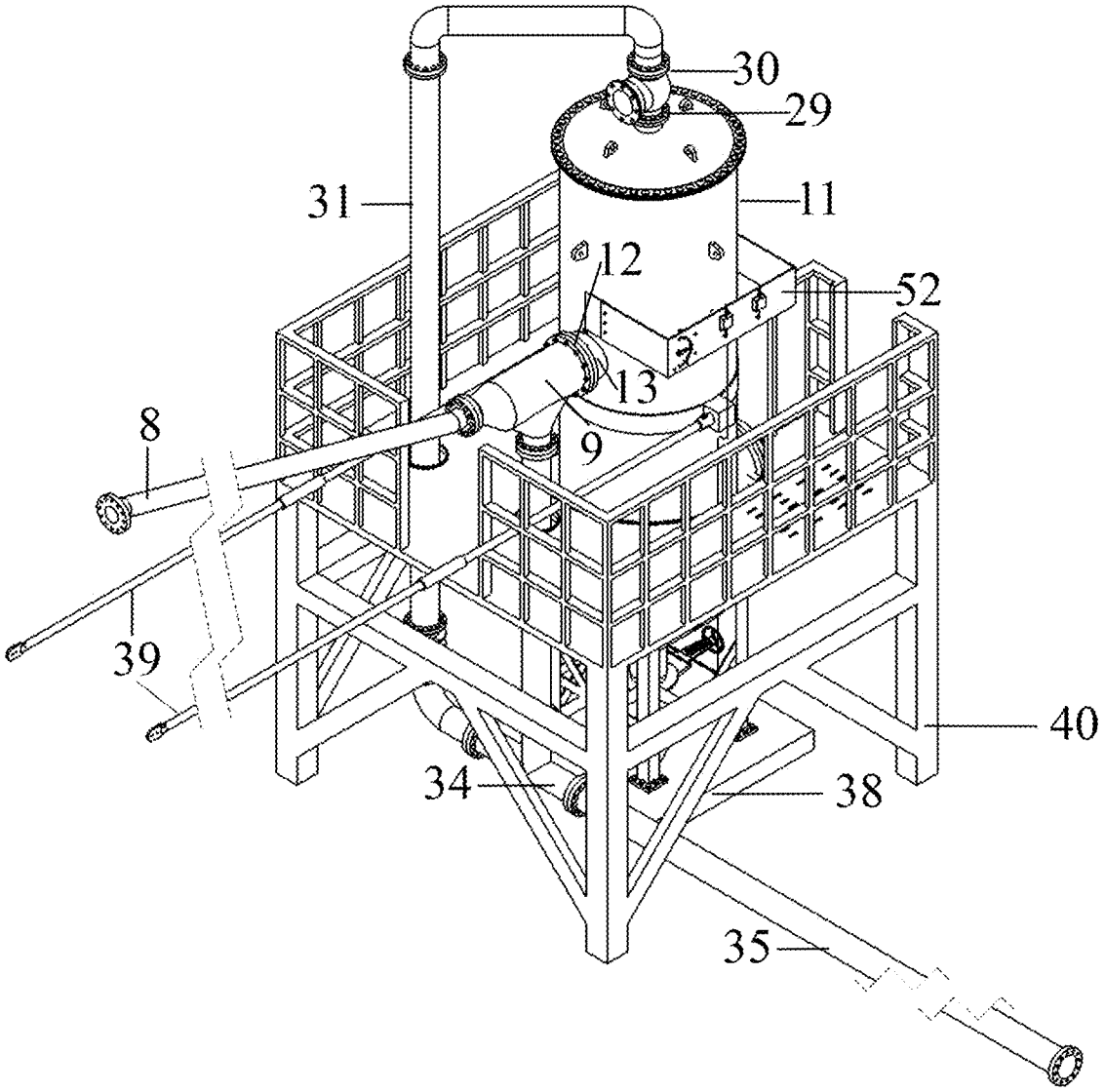
FIG. 1 is a structure diagram of the present invention.

Where, 1—drill pipe, 2—wellhead four-way joint, 3—blowout preventer stack, 4—rotating blowout preventer, 5—outlet of rotating blowout preventer, 6—emergency three-way joint, 7—liquid control sluice valve, 8—guiding tube, 9—guiding three-way joint, 10—vertical guiding tube, 11—sand-storing tank body, 12—sand-inlet short tube, 13—sand-inlet, 15—flap plate, 16—tongue skirt, 17—spheric balancer connecting rod, 18—spheric balancer, 19—hinge shaft, 20—supporting seat, 21—pressure balance hole, 22—limiter, 23—flap plate locking mechanism, 24—angle sensor, 25—anti-erosion lining plate, 26—dust board, 28—sand out, 29—top exhaust port, 30—first single-disc check valve, 31—gas discharge tube, 32—mass flowmeter, 33—second single-disc check valve, 34—T-shaped three-way joint, 35—blooie line, 36—man-assisted-sand-removing opening, 37—tank base, 38—cement foundation, 39—tank drawbar, 40—working stand combination, 42—clump weight, 43—anti-erosion fairing ring, 44—needle, 45—wireless angle transmitter, 46—wireless weight transmitter, 47—flipping-angle connecting rod, 48—flipping-angle connecting-rod-supporting tube, 49—hermetic bearing, 50—angle-measuring data wire, 51—weight-measuring data wire, 52—displaying panel, 53—weight sensor, 54—inner cup, 55—sluice valve, 56—deadlock bolt, 57—flipping-angle synchronizing rod, 58—the base of weight sensor.

DETAILED DESCRIPTION OF SOME EMBODIMENTS

In order to specify the objective, technical solution and advantage of the examples of the present invention, we shall clearly and completely describe the technical solution in the examples of the present invention in combination with the drawings in the examples of the present invention as follows, it is obvious that the described examples are a part of the embodiments of the present invention, but not embody all examples. Normally, the components described and shown herein may be configured and designed through various arrangements.

It should be noted that similar marks and letters indicate similar items in the drawings as follows, therefore, once an item is defined in a drawing, it does not need to be further defined and explained in subsequent drawings.

Now, we shall describe some embodiments of the present invention in detail in combination with the drawings as follows. If not conflicting with each other, the following examples and the technical features in the examples may be combined with each other.

In view of the technical problem that the process of gas drilling for oil-and-gas exploration and development is prone to abruptly block the blooie line, the present invention provides a technical solution. Now, we take a big stream of fragments and natural gas (big streams of fragments arising from other ways are similar) arising from gaseous rock bursts in the process of gas drilling as an example to explain the principal and application the present invention. The necessary technical terms involved in the present invention include: 1. GAS DRILLING, which refers to a drilling technology applying gas (natural gas, air, nitrogen, etc.) as a drilling operating fluid; 2. NORMAL DRILLING PROGRESS, which refers to a process that a fluid circulates and a drill bit rotates applying bit weight to crush the rock to deepen the wellbore, during which a small amount of particles and dust arising from the broken rock of the well bottom stably, uniformly; 3. ABNORMAL DRILLING PROGRESS, which refers to a process that the drilling goes with a sudden complex situation at the bottom hole, herein it specifically refers to the sudden occurrence of a big stream of fragments in the well. 4. DRILLING CUTTINGS, which refer to rock particles and dust generated in real time by the drill bit breaking the rock at the bottom hole during normal drilling progress; 5. BIG STREAM OF FRAGMENTS, which refers to a big stream of crushed rock particles and dust abruptly occurring in the wellbore, the big stream of fragments stems from the rock suddenly collapsing at the bottom hole and the well wall, or the accumulation of cuttings left with previous drilling progress (an annular sand bridge, sand accumulation at the bottom hole), or other accumulated fragment matter; 6. INJECTED GAS, which refers to an operating fluid that is artificially injected into the drill string during gas drilling, enters an annular through the drill bit, and carries cuttings to expel them from the wellhead through the annular, generally refers to nitrogen, air, natural gas, etc; 7. NATURAL GAS FROM THE FORMATIONS, which refers to gas generated in the drilled formations, generally natural gas; 8. GASEOUS ROCK BURST, (Meng Yingfeng et al., 2015), which refers to a phenomenon that the rock at the bottom hole is suddenly burst by high-pressure natural gas in the fracture in the formation, and a large amount of cuttings and dust are rushed into the wellbore with high-pressure natural gas, the phenomenon prevails in the gas drilling of tight sandstone gas reservoirs with sparse fractures.

Example 1

Figure 2:
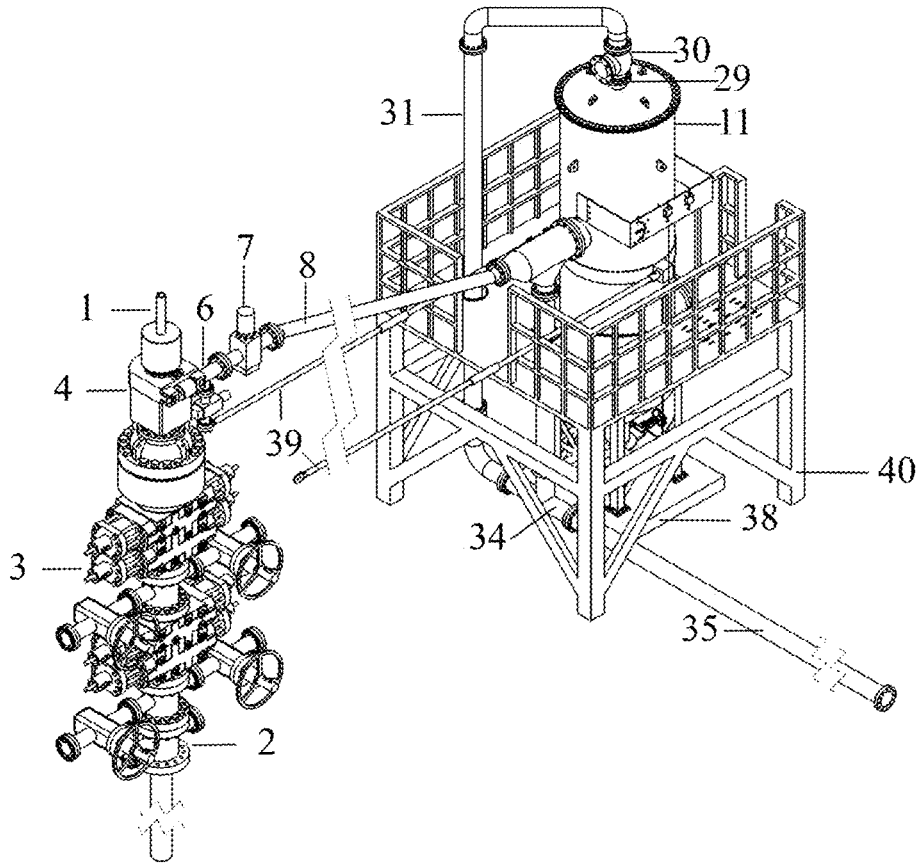
FIG. 2 shows a connection between the present invention device and the blowout preventer stack at the wellhead.
Figure 3:
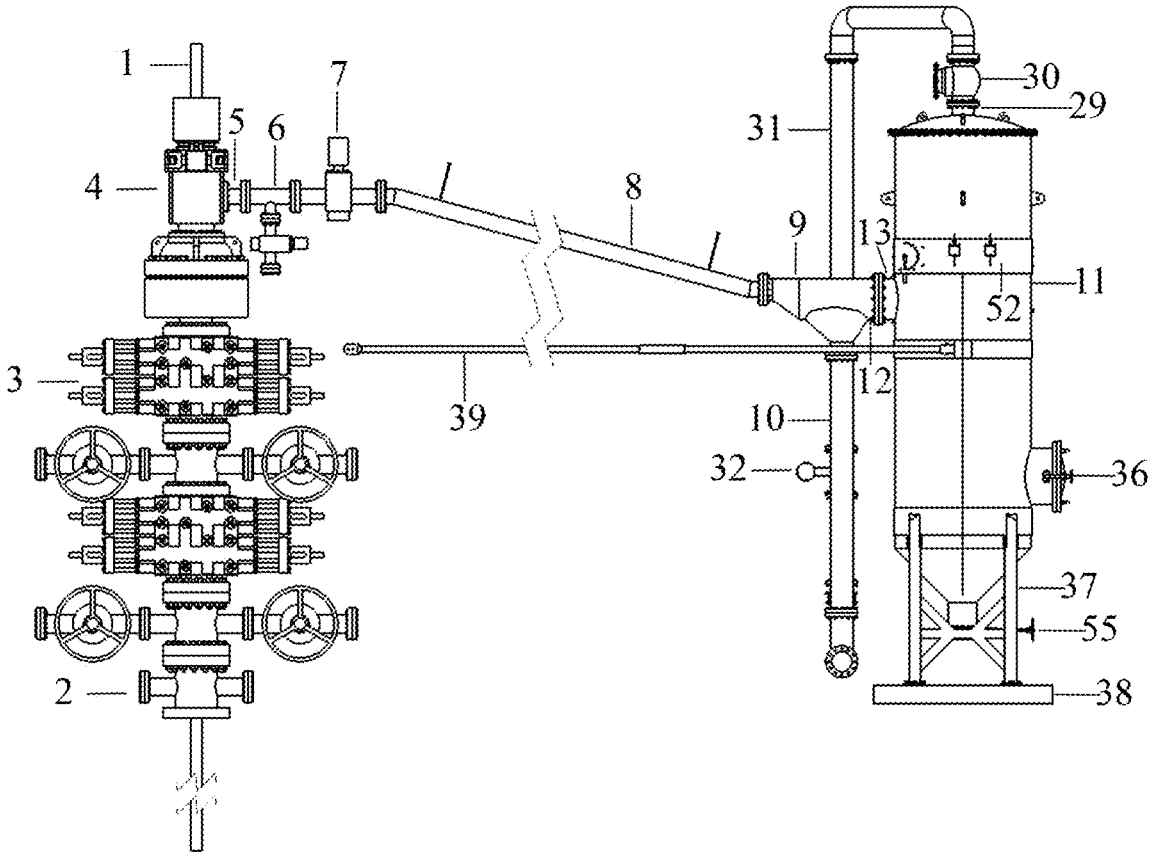
FIG. 3 is a front view showing the connection between the present invention device and the blowout preventer stack at the wellhead.
Figure 4:
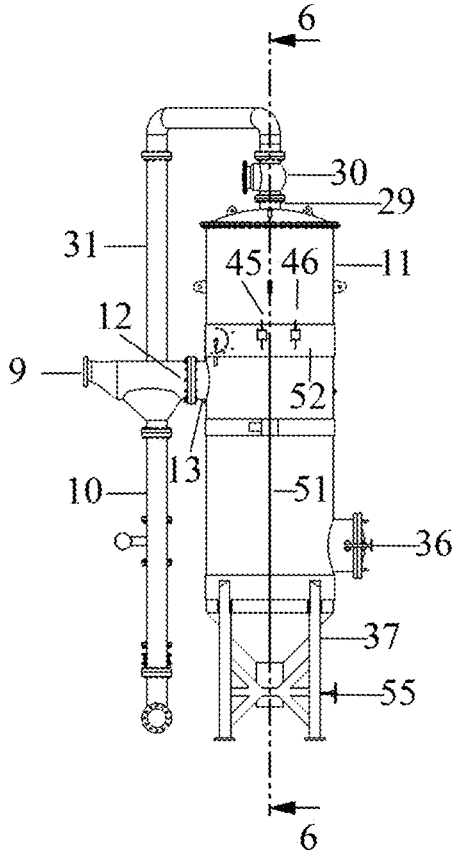
FIG. 4 is a front view of the present invention.
Figure 5:
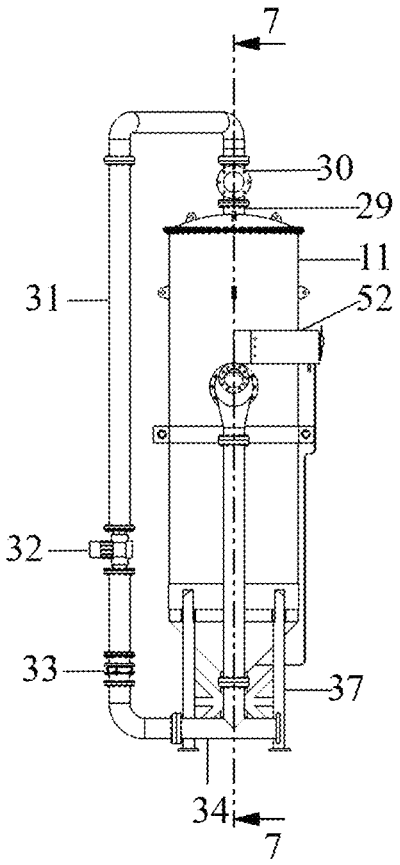
FIG. 5 is a left view of the present invention.
Figure 6:
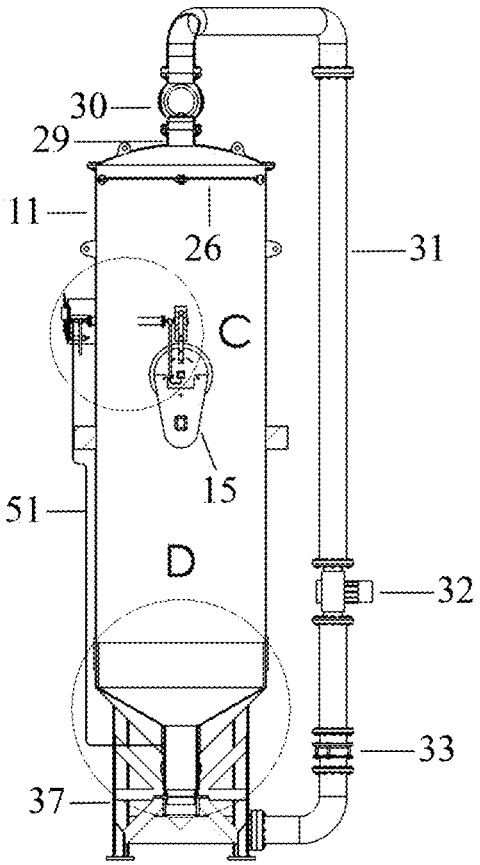
FIG. 6 is a sectional view at 6-6 in FIG. 4.
Figure 7:
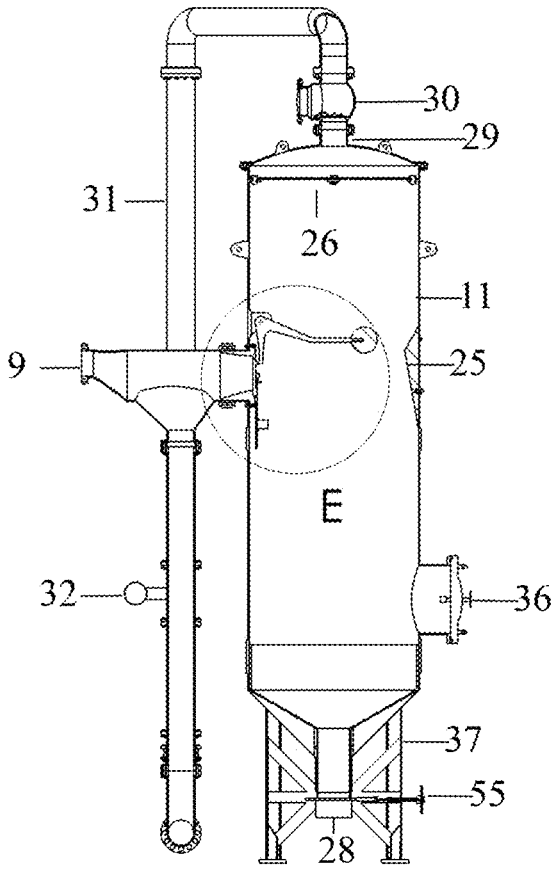
FIG. 7 is a sectional view at 7-7 in FIG. 5.
Figure 8:
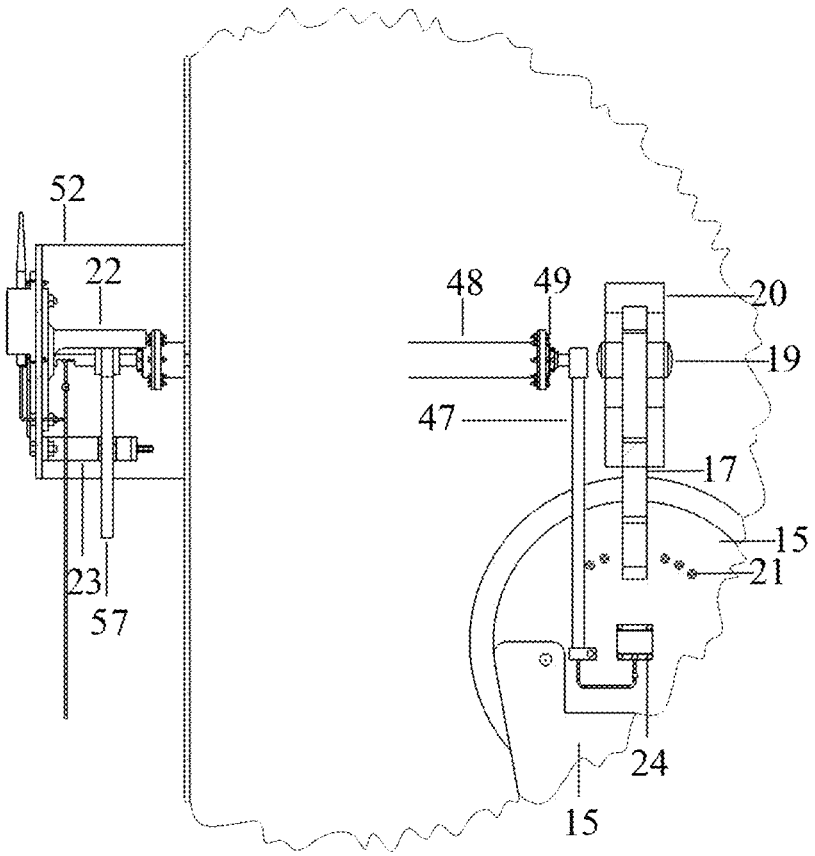
FIG. 8 is an enlarged view of C in FIG. 6.
Figure 9:
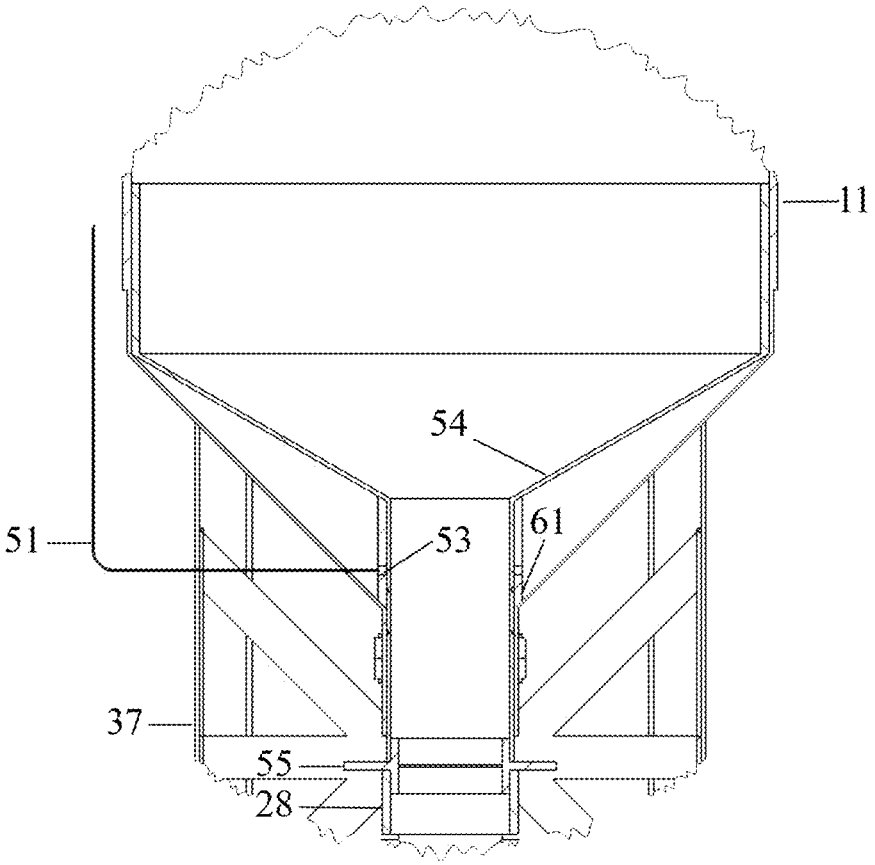
FIG. 9 is an enlarged view of D in FIG. 6.
Figure 10:
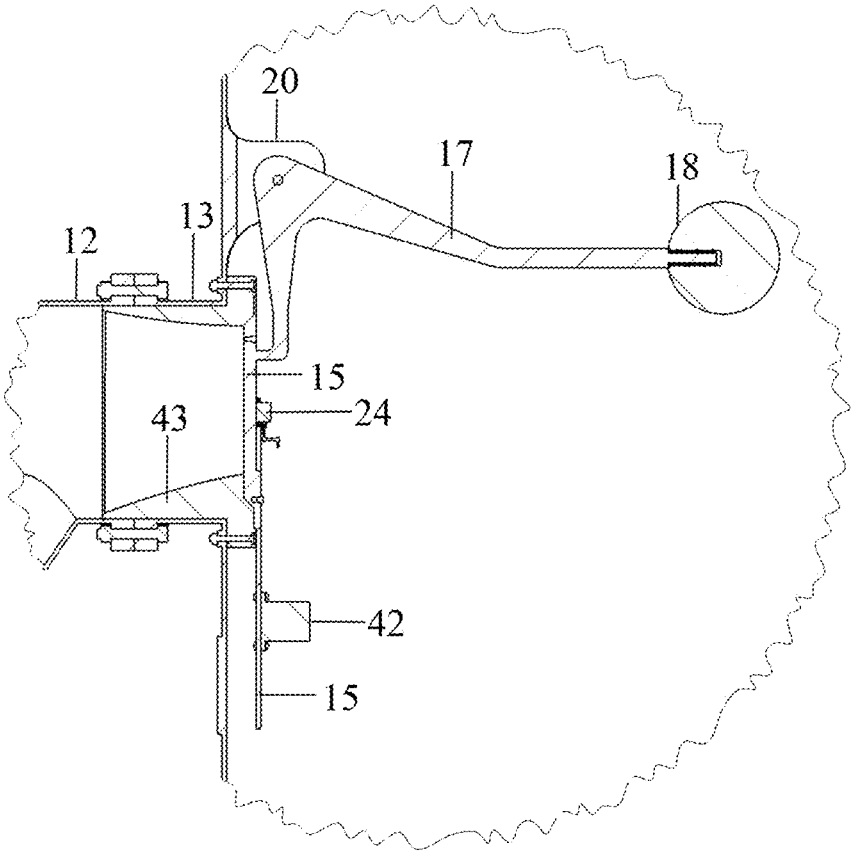
FIG. 10 is an enlarged view of E in FIG. 7.
Figure 11:
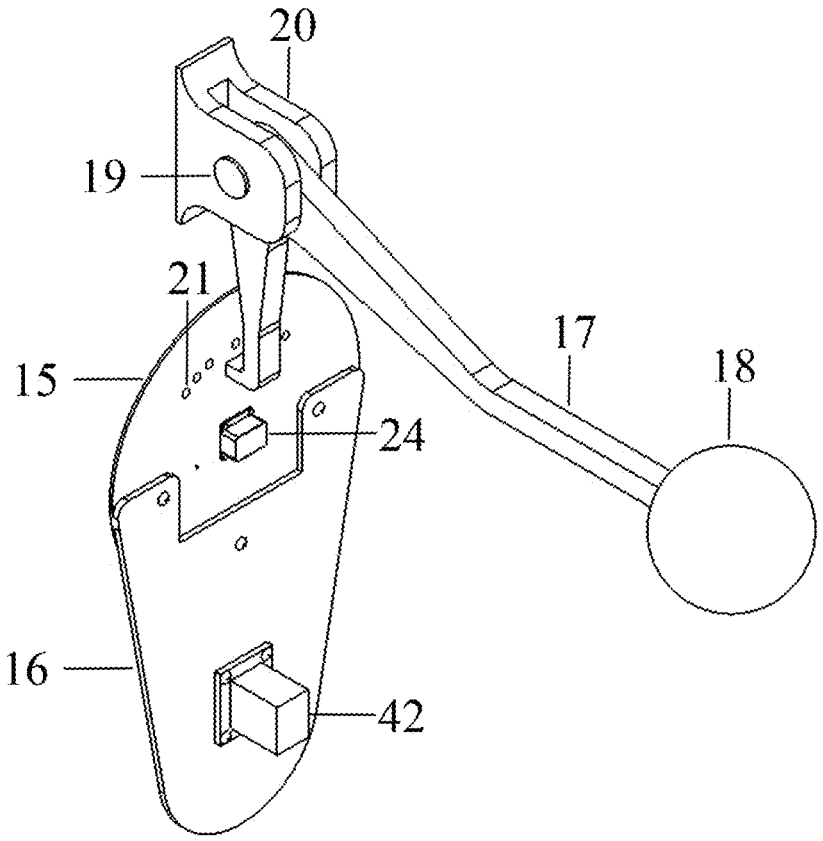
FIG. 11 is a structure diagram of the flap plate assembly.
Figure 12:
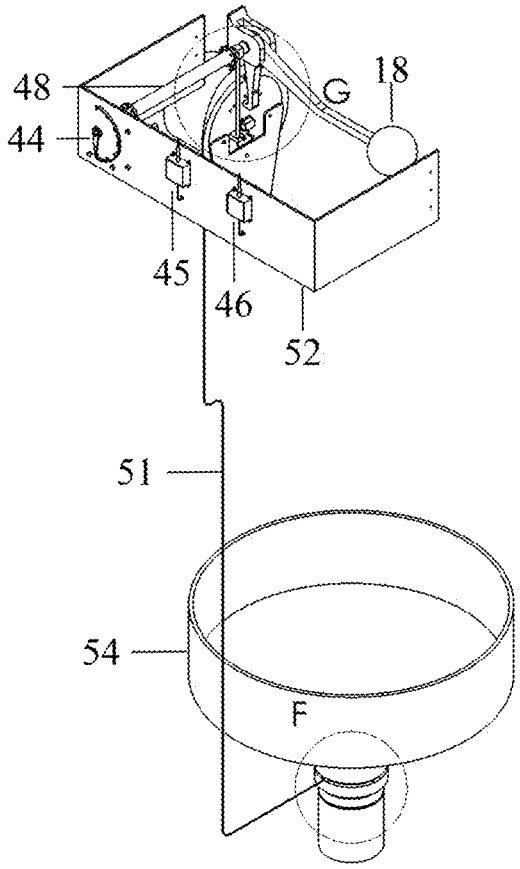
FIG. 12 is a structure diagram of the flap plate assembly and the accumulated-fragment's weight-measuring unit includes an inner cup.
Figure 13:
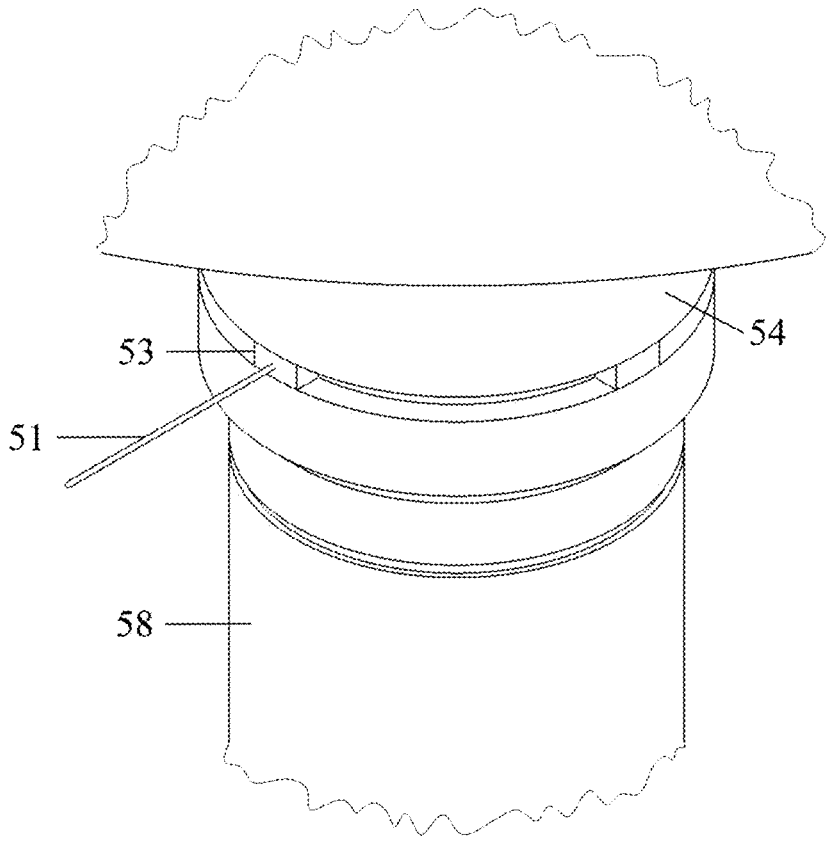
FIG. 13 is an enlarged view of F in FIG. 12.
Figure 14:
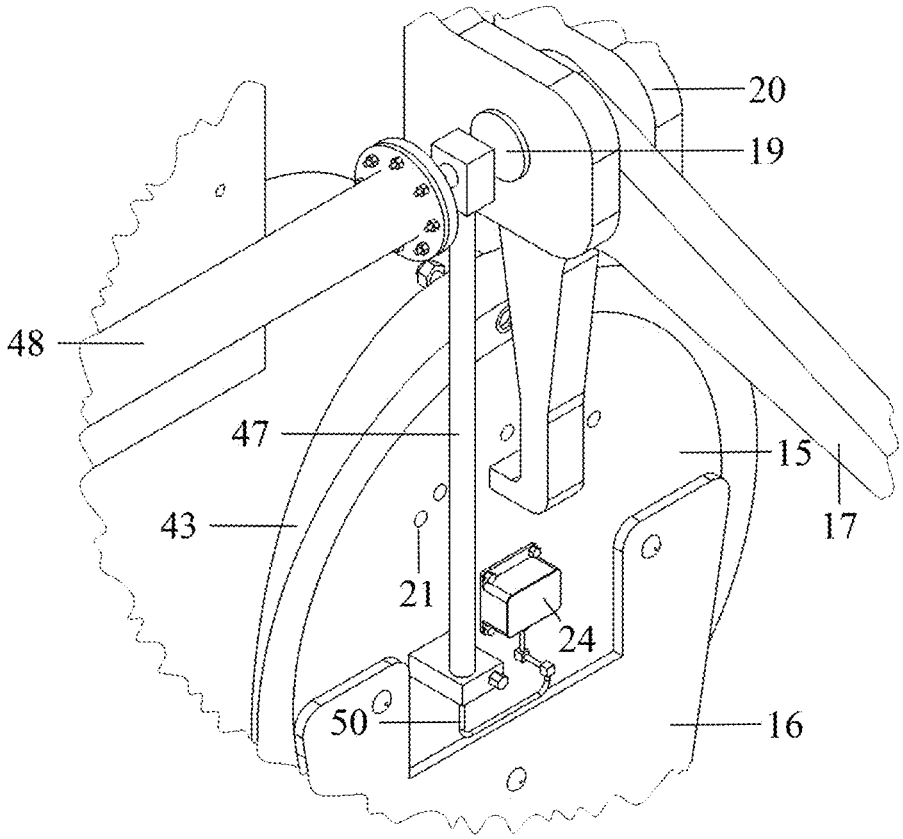
FIG. 14 is an enlarged view of G in FIG. 12.
Figure 15:
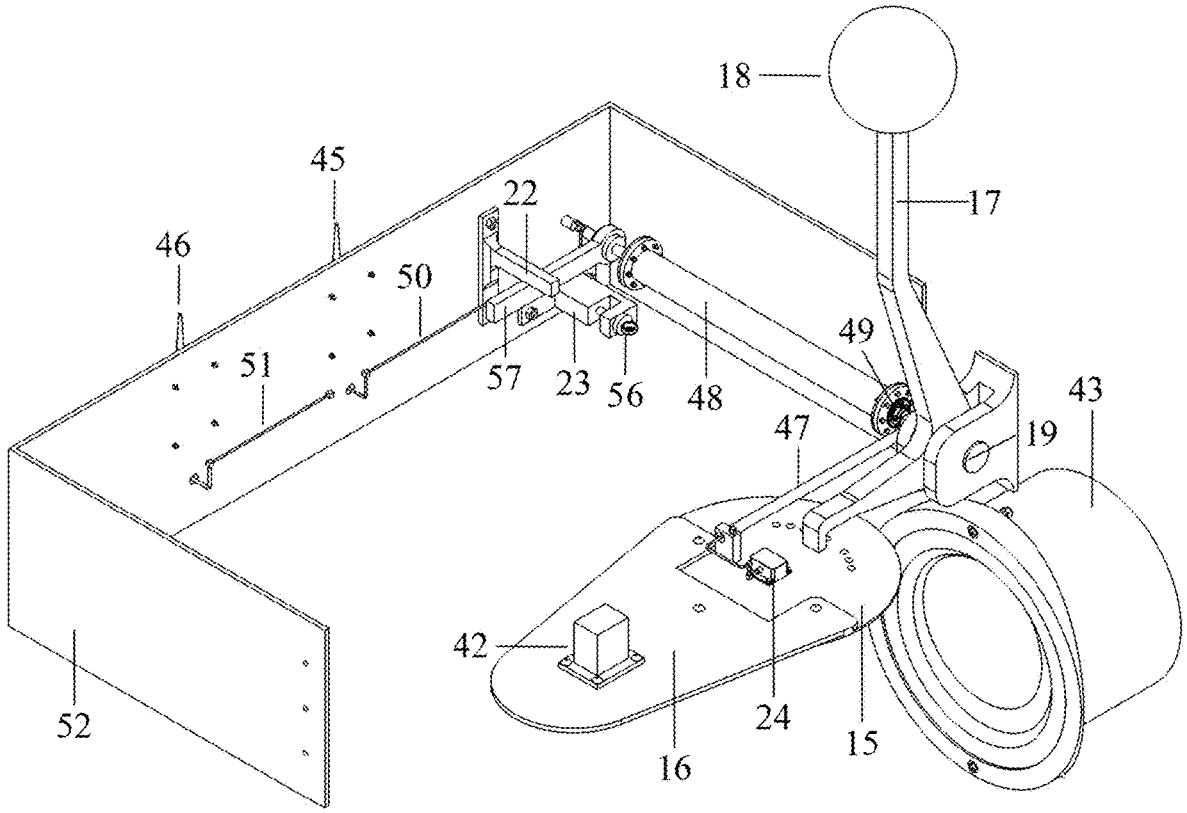
FIG. 15 shows an opening state of the flap plate.
Figure 16:
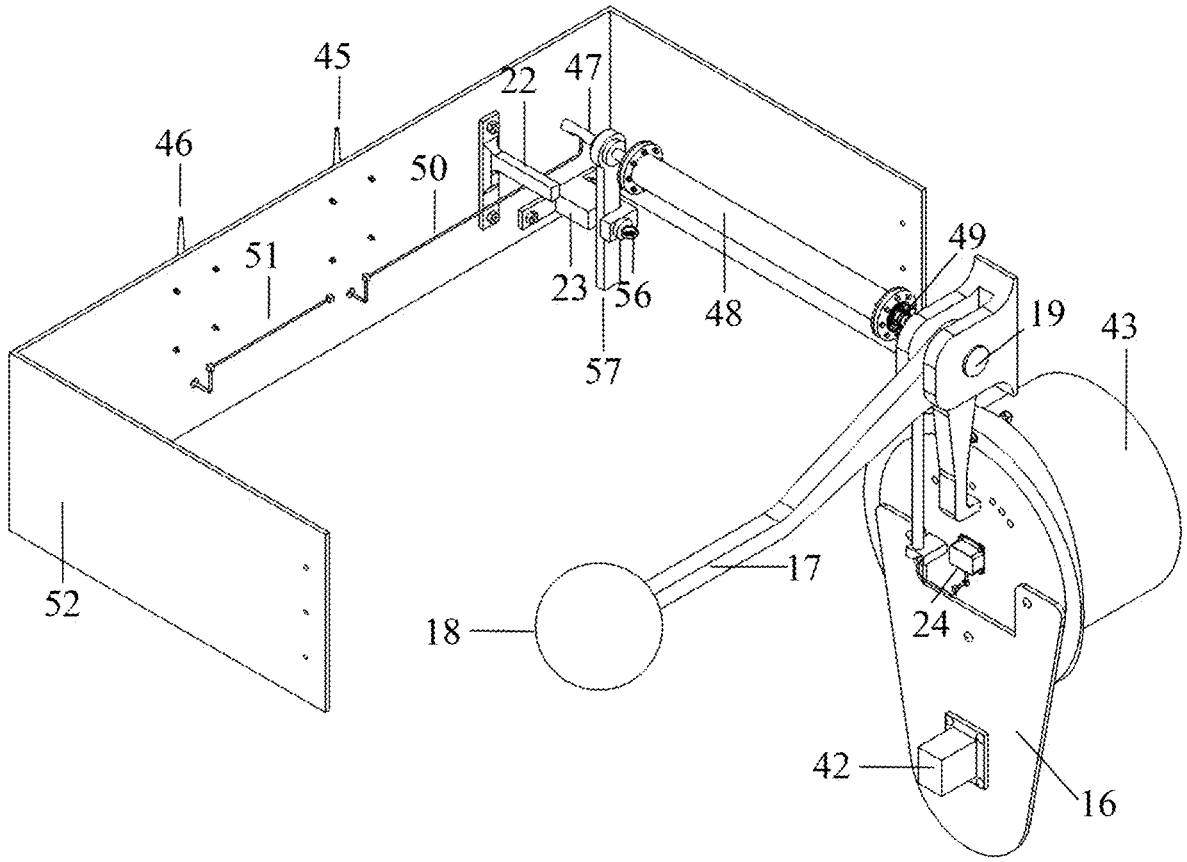
FIG. 16 shows a closing state of the flap plate.
Figure 17:
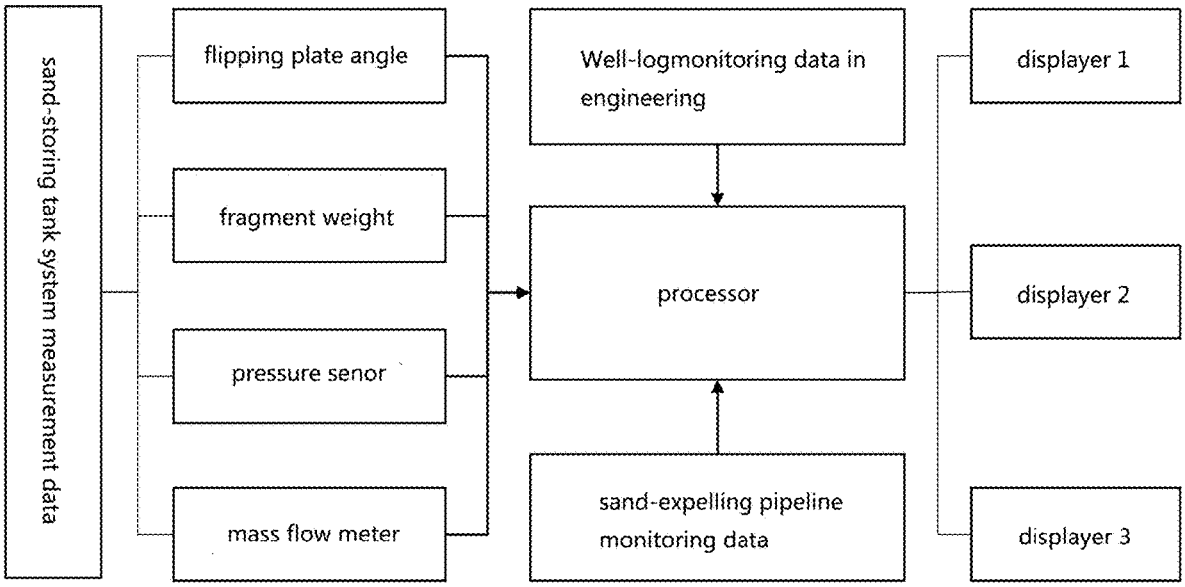
FIG. 17 is a block diagram of the host system.

As shown in FIGS. 1-17, a device for preventing abrupt blockage in blooie line of gas drilling, includes the sand-storing tank body 11, which is connected to the rotating blowout preventer 4 through the guiding tube 8, and the guiding three-way joint 9 is set between the guiding tube 8 and the sand-storing tank body 11 and connected to the blooie line 35 by the vertical guiding tube 10; the sand-storing tank body 11 is connected to the blooie line 35 by means of the gas discharge tube 31; the flap plate assembly is arranged at the position fronting straight onto the guiding three-way joint 9 inside the sand-storing tank body 11, and configured to control the rock particles in the guiding tube 8 to enter the sand-storing tank body 11, preventing blockage in the blooie line 35.

In this example, the guiding tube 8 is a pipe with small diameter (e.g., 7 inches), 6 to 8 meters in length, which is arranged between the outlet of the liquid control sluice valve 7 and the inlet of the guiding three-way joint 9, slightly sloping downwards, it is used to convey the gas and rock particles ejected from the well, meanwhile rapidly accelerate the horizontal movement of the rock particles. Furthermore, the liquid control sluice valve 7 is connected to the rotating blowout preventer 4 by means of the emergency three-way joint 6, before the rotating blowout preventer 4 there is the drill pipe 1 arranged, and behind it there are the blowout preventer stack 3 and the wellhead four-way short joint 2 arranged.

In this example, the sand-inlet short tube 12 is arranged between the guiding three-way joint 9 and the sand-storing tank body 11, and connected to the sand-inlet 13 opened on the sand-storing tank body 11, the anti-erosion fairing ring 43 is set inside the sand-inlet 13. The flap plate assembly includes the supporting seat 20 and the flap plate 15, the flap plate 15 is set on the supporting seat 20 by means of the hinge shaft 19, the tongue skirt 16 is arranged on the flap plate 15, the clump weight 42 is arranged on the tongue skirt 16; the spheric balancer connecting rod 17 is arranged on the hinge shaft 19, the spheric balancer 18 is arranged on the spheric balancer connecting rod 17. The flap plate assembly can ensure that the flap plate closes during normal drilling progress by changing the weight of the clump weight 42 and the spheric balancer 18; the flap plate 15 closes in the drilling conditions of medium and low gas production (less than 300,000 cubic meters/day); when the mass flow rate of rock particles in the gas stream from the outlet suddenly increases to more than 10 kg/s (the mass flow rate of cuttings is about 0.1-0.5 kg/s during normal drilling progress), the impact force of the mass of rock particles will open the flap plate 15, and the particles will enter the sand-storing tank body 11 under the action of inertial force; the larger and faster the mass flow rate of rock particles, the larger the opening of the flap plate 15, which allows more fragments to quickly enter the sand-storing tank body 11; when the mass flow rate of rock particles in the gas stream from the outlet decreases to less than 1 kg/s, the flap plate 15 automatically closes.

Furthermore, the guiding three-way joint 9 is an asymmetric T-shaped three-way joint, its horizontal upstream inlet is connected to the outlet of the horizontal guiding tube 8, its horizontal downstream outlet is connected to the sand-inlet 13, and its vertical downstream outlet is connected to the inlet of the vertical guiding tube 10 vertically downwards. The length, shape and eccentricity of the passage inside the guiding three-way joint 9 form a diffusive eccentric passage, which ensures the separation of the gas's flow from the particle's trajectory, guiding the gas flow to turn down into the vertical downstream outlet, and the rock particles to hit on the flap plate 15 along a horizontal para-curve. If the flap plate 15 closes, the rock particles hit on flap plate 15 then bounces off, next enters the vertical guiding tube 10 of the guiding three-way joint 9, jointly led by gravity and gas flow. If the flap plate 15 opens, the rock particles hit on the flap plate 15 then bounce directly into the sand-storing tank body 11, and then fall into the bottom of the sand-storing tank body 11 under the action of gravity. The vertical guiding tube 10 is a vertical pipe having the same diameter as the blooie line 5, its upper inlet is connected to the vertical downward outlet of the guiding three-way joint 9, its lower outlet is connected to the T-shaped three-way joint 34, and leads to the inlet of the blooie line 35 through the T-shaped three-way joint 34. The sand-storing tank body 11 is a well-closed container capable of having a sufficiently large volume and bearing sufficiently high pressure, which is used to separate gas from fragments, and contain all big streams of fragments caused by a gaseous rock burst, such container may be 6 m in height, 2 m in diameter. The sand-inlet short tube 12 is a horizontal outlet section of the guiding three-way joint 9, namely a circular tube having the same diameter as the sand-inlet 13 and connected to the sand-inlet 13, it is used to convey rock particles to the sand-inlet 13, its length and shape is determined by analyzing particle's collision and re-bounce, so as to prevent gravity retention after particle's rebounding. The sand-inlet 13 is a circular hole opened on the cylindrical wall of the sand-storing tank body 11, allowing a big stream of fragments to enter the passage of the sand-storing tank body 11, and its position, shape and size are determined by analyzing the random collision point distribution of gas-solid particles.

Furthermore, the anti-erosion fairing ring 43 is an eccentric conical pipe inlaid with hard alloy or sprayed with anti-erosion coating inside, which is installed inside the sand-inlet 13, it is used to solve the potential erosion problem of the sand-inlet 13 caused by high-speed moving fragments, meanwhile, its eccentric conical tube structure also effects a fairing shape for the gas-solid two-phase flow, and avoids the accumulation of fragments on the low side of the sand-inlet 13, rooting out the problem of lax closing of the flap plate 15 caused by the accumulation.

In this example, in the non-impact area of the upper part of the flap plate 15, there are pressure balance holes 21. A number of pressure balance holes 21 are opened to balance the pressure on both sides of the flap plate 15, so as to prevent pressure difference from affecting the opening of the flap plate 15, the pressure balance hole 21 adopts an inverted conical structure to prevent the blockage of dust frontally impacting.

In this example, an angle-measuring unit is further arranged inside the sand-storing tank body 11, the angle-measuring unit includes the angle sensor 24, the flipping-angle connecting rod 47 and the flipping-angle connecting-rod-supporting tube 48, the angle sensor 24 is arranged on the flap plate 15 of the flap plate assembly, and connected to the wireless angle transmitter 45 through the angle-measuring data wire 50, the wireless angle transmitter 45 sends the angular data of the flap plate 15 to the host for display, the angle-measuring data wire 50 is arranged inside the flipping-angle connecting rod 47, one end of which is connected to the flap plate 15, and the other end of which is connected to the flipping-angle connecting-rod-supporting tube 48. Furthermore, the flipping-angle connecting-rod-supporting tube 48 is welded on the sand-storing tank body 11 and coaxial with the hinge shaft 19, the flipping-angle connecting rod 47 is a Z-shaped connecting rod, one section of which is fixed on the flap plate 15, and the other end of which is connected to the needle 44, then extends into the inside of the flipping-angle connecting-rod-supporting tube 48, held by the hermetic bearing 49. When the flap plate 15 flips, the angle sensor 24 measures the turn-angle of the flap plate 15 in real time, and sends the measurement signal to the wireless angle transmitter 45 through the angle-measuring data wire 50, and then transmits it wirelessly to the host in real time to achieve automatically attaining the turn-angle of the flap plate 15 in real-time. In addition, the needle 44 synchronously rotates with the flap plate 15 in real-time by means of the flipping-angle connecting rod 47, and synchronously displays the turn-angle of the flap plate 15 by mechanical means, and the two ways of attaining the turn-angle of the flap plate 15 ensure that the switching state of the flap plate 15 can be acquired in real time.

In this example, the anti-erosion lining plate 25 is arranged inside the sand-storing tank body 11, preferably, it is directly arranged opposite the sand-inlet 13, so as to prevent and alleviate the erosion of big streams of fragments on the inner wall of the tank body; the dust board 26 is arranged on the upper portion of the sand-storing tank body 11, so that the gas flow carrying the floating dust flows back to the top exhaust port 29, and the particles are blocked inside the sand-storing tank body 11.

In this example, the flipping-angle synchronizing rod 57 is arranged on the flipping-angle connecting rod 47, the flipping-angle synchronizing rod 57 synchronizes with the turn of the flap plate 15. When the turn-angle of the flap plate 15 reaches a preset limit angle, the flipping-angle synchronizing rod 57 hits on the limiter 22 and cannot rotate further, thereby achieving limiting the flipping-range of the flap plate 15. The limiter 22 is arranged on the inner wall of the displaying panel 52 of the sand-storing tank body 11, the displaying panel 52 is arranged on the side wall of the sand-storing tank body 11.

In this example, the flap plate locking mechanism 23 is further arranged on the inner wall of the displaying panel 52, the flap plate locking mechanism 23 is used to prevent the gas flow from blowing open the flap plate 15 at the time of using the blooie line for spouting or testing in conditions of large gas production. When it is necessary to lock the flap plate 15, pull the flipping-angle synchronizing rod 57 to a closed position of the flap plate locking mechanism 23, then insert the deadlock bolt 56 to lock the flipping-angle synchronizing rod 57.

In this example, an accumulated-fragment's weight-measuring unit is further arranged inside the sand-storing tank body 11, the accumulated-fragment's weight-measuring unit includes the inner cup 54, the base of weight sensor 58 and the weight sensor 53, the inner cup 54 is arranged at the bottom of the sand-storing tank body 11; the base of weight sensor 58 is arranged inside a sand out 28 of the sand-storing tank body 11, and supported by the latter; the weight sensor 53 is arranged between the inner cup 54 and the base of weight sensor 58; the weight sensor 53 is connected to the wireless weight transmitter 46 through the weight-measuring data wire 51, the wireless weight transmitter 46 sends the signal of the weight of the fragments accumulated inside the sand-storing tank body 11 to the host for display. Furthermore, after the fragments have entered the sand-storing tank body 11, they fall in the inner cup 54 under the action of gravity and the sand-blocking plate 26, their weight acts on the weight sensor 53 via the inner cup 54, the measured pressure is transmitted to the wireless weight transmitter 46 through the weight-measuring data wire 51, and transmitted to the host in real time. The sand out 28 is arranged at the bottom of the sand-storing tank body 11, and a sluice valve 55 is also arranged thereon, used to expel the fragments accumulated in the sand-storing tank body 1 at the time of stopping drilling progress.

In this example, the exhaust port 29 is arranged at the top of the sand-storing tank body 11, and connected to the gas discharge tube 31; the mass flowmeter 33 and two single-disc check valves are arranged on the gas discharge tube 31. Furthermore, the first single-disc check valve 30 is arranged at the gas outlet of the exhaust port 29, allowing the gas inside the sand-storing tank body 11 to be discharged into the blooie line 35, so as to prevent the flow backward into the sand-storing tank body 11 caused by pressure impacts inside the blooie line 35. The gas discharge tube 31 is used to convey a mixture of gas and floating dust to the blooie line 35 in the process of expelling a big stream of fragments by opening the flap plate 15; the mass flowmeter 32 is arranged in the gas discharge tube 31, used to measure, display, record the mass flow of the mixture of the gas and floating dust inside the gas discharge tube 31. The second single-disc check valve 33 is arranged at the gas outlet of the gas discharge tube 31, allowing the gas to be discharged from the inside of the sand-storing tank body 11 into the blooie line 35, so as to prevent the flow backward into the sand-storing tank body 11 caused by pressure impacts inside the blooie line 35. The diameter, length and installation mode of the blooie line 35 are determined according to the needs of the project, and there are no additional requirements for this device and method.

In this example, the man-assisted-sand-removing opening 36 used to remove sand or rinse the residue of the mud inside the sand-storing tank body 11 under manual assistance is arranged on the sand-storing tank body 11. The tank base 37, the cement foundation 38, the tank drawbar 39 and the working stand combination 40 are further arranged outside the sand-storing tank body 11, the tank base 37 is configured to support the sand-storing tank body 11 and fix the sand-storing tank body 11 on the cement foundation; the cement foundation 38 is configured to fix the sand-storing tank body 11 firmly; the tank drawbar 39 is configured to firmly connect the sand-storing tank body 11 with a drilling machine base; the working stand combination 40 is configured to facilitate various maintenance operations.

Furthermore, the host can calculate the mass flow change of gas-solid phase particles and the total amount of the discharged fragments, according to the dynamic recorded data of the opening angle of the flap plate 15, in combination with the recorded data of the mass flowmeter 32 of the gas discharge tube and the recorded data of the gas flow sensor and the solid flow sensor on the blooie line 35, and integrate the measurement data of the pressure sensor of the horizontal guiding tube with the well-log data in engineering for the reference of decision-making in operation.

The workflow of the present invention is as follows.

During drilling progress, gas is injected into the wellbore by drill pipe 1, leaves the bit water way, carries the cuttings at the bottom hole and mixes with the natural gas from the formations (if any), then enters the annular hollow, next enters the horizontal guiding tube 8 via the wellhead four-way short joint 2, the blowout preventer stack 3, the rotating blowout preventer 4, the rotating blowout preventer outlet 5, the emergency three-way joint 6 and the liquid control sluice valve 7.

During normal drilling progress, there is no gas generated in a formation, and the drill bit breaks the formation, brings about a bit of cuttings, gas is injected thereinto to carry the cuttings back out of the wellhead, then arrives at the guiding three-way joint 9 via the guiding tube 8, the gas flow runs inside the guiding three-way joint 9, separating the gas from the solid, then the gas and the floating dust turn round inside the guiding three-way joint 9 and flow into the vertical guiding tube 10, next enter the blooie line 35 on the ground via the T-shaped three-way joint 34. The rock particles inside the guiding three-way joint 9 run along a horizontal para-curve under the action of inertia, and directly hit on the closed flap plate 15 via the sand-inlet short tube 12 and sand-inlet 13 to generate impact force; as the closing torque caused by the spheric balancer 18 acting on the flap plate 15 of the flap plate assembly is much greater than the opening torque of the flap plate concurrently arising from the impact force of the gas flow and cuttings, the flap plate 15 remains close. The particles of the cuttings hitting on the flap plate 15 rebound, fall back, and enter the guiding three-way joint 9, then enter the blooie line 35 on the ground via the T-shaped three-way joint 34 and the vertical guiding tube 10, under the drag of the gas flow. Therefore, during normal drilling progress, the flap plate 15 remains close, the injected gas carries the cuttings, which are expelled from the wellhead, then enters the blooie line 35 on the ground.

In the case that gas production continues but a little in the formation (generally 300,000 cubic meters per day as an upper limit for reference), it is still desired to continue drilling, at this time, there is no gaseous rock burst, or the gaseous rock burst has occurred and its effect has disappeared, the rock particles only include cuttings generated with drilling progress. Compared with the normal drilling progress, due to the increase of the total amount of return gas, the impact force both from the gas flow and the rock fragments have increased a lot. At this time, the closing torque caused by the spheric balancer 18 acting on the flap plate 15 is designed to be much greater than the opening torque of the flap plate jointly arising from the impact force of the gas flow and rock fragments, ensuring that the flap plate 15 remains close. Therefore, during drilling progress at low gas production, the flap plate 15 remains close, the injected gas mixes with the natural gas from the formations, carrying the rock fragments, which are expelled from the wellhead, then enters the blooie line 35 on the ground.

During drilling progress, in the case that a gaseous rock burst abruptly occurs, a certain amount of big streams of fragments (generally below 0.5 cubic meters) and a stream of high-pressure gas flow will suddenly occur at the bottom hole. The big streams of fragments enter the guiding tube 8 after being expelled from the wellhead with the gas flow, then the fragment particles are accelerated in horizontal movement inside the guiding tube 8, next enter the guiding three-way joint 9 at high speed, so that the diffusive eccentric passage inside the guiding three-way joint 9 ensures that most fragment particles hit on the flap plate 15. The high-dense and high-speed fragment particles hit on the flap plate, so as to create a big opening torque of the flap plate, when the opening torque of the flap plate is much greater than the closing torque caused by the spheric balancer 18 acting on the flap plate 15, the flap plate 15 opens, and the opening range of the flap plate depends on the mass flow rate and velocity of the fragment particle group. When the flap plate opens, most gas carrying floating dust directly enters the vertical guiding tube 10 along a bend flow field, but the fragment particles together with a small part of gas carrying floating dust enter the sand-storing tank body 11 via the sand-inlet 13. The gas-solid mixed fluid entering the sand-storing tank body 11 immediately decelerates and the gas separates from the solid under gravity, then the particles sink and accumulate onto the bottom of the sand-storing tank body, the gas carrying floating dust, zigzags through the dust board 26 to the exhaust port 29 at the top of the tank body, then enters the blooie line 35 on the ground via the first single-disc check valve 30, the gas discharge tube 31, the mass flowmeter 32, the second single-disc check valve 33 and the T-shaped three-way joint 34. In this way, in the process of removing the big streams of fragments caused by the gaseous rock burst, only the gas carrying floating dust enters the blooie line 35, all the granular fragments caused by the rock burst accumulate in the sand-storing tank body 11. In the process of removing the rock-burst fragments, the opening angle of the flap plate 15 changes continuously with the impact force on itself, and this impact force is jointly determined by the kinetic energy of the mass flow of the rock-burst fragments and that of the gas flow. Therefore, the device can calculate the mass flow change of gas-solid phase particles, and give the total amount of the rock-burst fragments through calculus, according to the angle change of the flap plate 15 in real time recorded by the angle-measuring unit 24, in combination with the real time monitor data provided by the mass flowmeter 32 on the gas discharge tube 31 and the flow sensor (not shown) on the blooie line 35. The fragment weight sensor 27 located in the lower part of the sand-storing tank body 11 also synchronously monitors the change of the total amount of fragments sinking in the sand-storing tank body 11.

After removing the big streams of fragments, the impact force of the rock particles on the flap plate 15 decreases, and the flap plate 15 automatically closes. As the normal drilling progress brings about rock fragments, then inject gas to mix with natural gas from the formations, and carry the rock fragments, which are expelled from the wellhead, then enter the blooie line 35 on the ground.

Generally, after stopping drilling progress, or during the interval between stopping drilling progress, gas injection stops, the sluice valve 55 at the tank bottom opens, the fragment matter accumulated in the tank body is expelled through the sand out at the bottom of the sand-storing tank body 11; if manual assistance is required, the man-assisted-sand-removing opening 36 opens for manual operations. If too much fragments accumulate in the sand-storing tank body 11 and may affect the device's normal operation, the drilling progress ceases, the gas injection stops, the liquid control sluice valve 7 closes, the natural gas in the blowout well discharges (if any) through the blowout pipeline (not shown). At the same time, the sluice valve 55 at the tank bottom opens, the fragments accumulated in the tank body discharges through the sand out at the tank bottom, if manual assistance is required, the man-assisted-sand-removing opening 36 opens for manual operations. After completing removing sand, all parts return to operation again and continue drilling progress.

If a gas reservoir is encountered and a high production is achieved, under the premise that the fragments in the well have been removed, the blooie line 35 can be used for spouting or testing. At this time, in order to prevent excessive gas volume from blowing open the flap plate 15, the deadlock bolt 56 locks.

In order to prevent the excessively strong and fierce impact force of big streams of fragments from causing the instability of the sand-storing tank body 11, the cement foundation 38 is used to firmly fix the tank base 37; at the same time, the tank drawbar 39 connected with the sand-storing tank body 11 is firmly connected to the drilling machine base. The working stand combination 40 is configured to provide a working space around the sand-storing tank body 11.

Other possible conditions as a big stream of fragments abruptly occurs in the wellbore are similar to the condition that a gaseous rock burst under the well suddenly brings about a big stream of fragments, so their operation process does not need to repeat.

What is claimed is:

1. A device for preventing abrupt blockage in a blooie line of a gas drilling system, comprising:

a sand-storing tank body, connected to a rotating blowout preventer through a guiding tube;

a guiding three-way joint, set between the guiding tube and said sand-storing tank body, the guiding three-way joint connected to the blooie line by a vertical guiding tube, wherein said sand-storing tank body is connected to the blooie line by means of a gas discharge tube; and a flap plate assembly, arranged inside the sand-storing tank body in fluid communication with the guiding three-way joint, and configured to open to allow rock particles in the guiding tube to enter the sand-storing tank body.

2. The device according to claim 1, wherein said flap plate assembly includes a supporting seat and a flap plate, the flap plate is set on the supporting seat by means of a hinge shaft, a tongue skirt is arranged on the flap plate, a clump weight is arranged on the tongue skirt; a spheric balancer connecting rod is arranged on the hinge shaft, and a spheric balancer is arranged on the spheric balancer connecting rod.

3. The device gas according to claim 1, wherein an angle-measuring unit is further arranged inside said sand-storing tank body, the angle-measuring unit includes an angle sensor, a flipping-angle connecting rod and a flipping-angle connecting-rod-supporting tube, the angle sensor is arranged on a flap plate of said flap plate assembly, and the angle sensor is connected to a wireless angle transmitter through an angle-measuring data wire, the wireless angle transmitter sends the angular data of the flap plate to a host for display, the angle-measuring data wire is arranged inside the flipping-angle connecting rod, one end of which is connected to the flap plate, and the other end of which is connected to the flipping-angle connecting-rod-supporting tube.

4. The device according to claim 3, wherein a flipping-angle synchronizing rod is arranged on the flipping-angle connecting rod, the flipping-angle synchronizing rod synchronizes with a turn of the flap plate, and when a turn-angle of the flap plate reaches a preset limit angle, the flipping-angle synchronizing rod hits on a limiter arranged on a displaying panel of said sand-storing tank body, and the flap plate cannot rotate further.

5. The device according to claim 4, wherein a flap plate locking mechanism is further arranged on the displaying panel, and wherein when the flipping-angle synchronizing rod is moved to a closed position of the flap plate locking mechanism, a deadlock bolt is configured to be inserted to lock the flipping-angle synchronizing rod.

6. The device according to claim 1, wherein a debris accumulation weight measuring unit is further arranged inside said sand-storing tank body, the debris accumulation weight measuring unit includes an inner cup, a weight sensor base and an weight sensor, the inner cup is arranged at the bottom of said sand-storing tank body; the weight sensor base is arranged inside the sand out of said sand-storing tank body, and supported by the sand out; the weight sensor is arranged between the inner cup and the weight sensor base; the weight sensor is connected to a wireless weight transmitter through a weight-measuring data wire, and the wireless weight transmitter sends a signal of a weight of the debris accumulated inside said sand-storing tank body to a host for display.

7. The device according to claim 1, wherein a sand-inlet short tube is arranged between said guiding three-way joint and said sand-storing tank body, and connected to a sand-inlet opened on said sand-storing tank body, and an anti-erosion fairing ring is set inside the sand-inlet.

8. The device according to claim 1, wherein an exhaust port is arranged at the top of said sand-storing tank body, and connected to the gas discharge tube.

9. The device according to claim 8, wherein a mass flowmeter and two single-disc check valves are arranged on the gas discharge tube.

10. The device according to claim 1, wherein a T-shaped three-way joint is set on the blooie line, the T-shaped three-way joint is configured to connect the vertical guiding tube with the gas discharge tube.

* * * * *